United States Patent [19]

Odashima

[11] Patent Number: 4,475,488

[45] Date of Patent: Oct. 9, 1984

[54] LUBRICATING SYSTEM FOR AN OUTBOARD MOTOR

[75] Inventor: Rou Odashima, Hamamatsu, Japan

[73] Assignees: Yamama Hatsudoki Kabushiki Kaisha; Sanshin Kogyo Kabushiki Kaisha, both of Japan

[21] Appl. No.: 459,227

[22] Filed: Jan. 19, 1983

[30] Foreign Application Priority Data

Jan. 22, 1982 [JP] Japan ..... 57-7636

[51] Int. Cl.[3] ..... F02B 33/04

[52] U.S. Cl. ..... 123/73 AD; 123/196 CP; 184/6.18; 184/6.28

[58] Field of Search ..... 123/196 R, 196 CP, 73 AD; 184/6.18, 6.28

[56] References Cited

U.S. PATENT DOCUMENTS

| | | | |
|---|---|---|---|
| 2,684,061 | 7/1954 | Kiekhaefer | 123/196 CP |
| 2,936,748 | 5/1960 | Jensen | 123/196 CP |
| 3,542,154 | 11/1970 | Morner | 123/196 CP |
| 3,765,393 | 10/1973 | Pipes | 123/196 CP |
| 4,372,258 | 2/1983 | Iwai | 123/73 AD |

*Primary Examiner*—Ethel R. Cross

*Attorney, Agent, or Firm*—Ernest A. Beutler

[57] ABSTRACT

A lubricating system for crankcase compression two-cycle engines embodying a positively driven oil pump. The oil pump is driven from the crankshaft by means of gears and a portion of the lubricating oil is delivered to a cavity in which these gears are located for lubricating the gears.

5 Claims, 3 Drawing Figures

LUBRICATING SYSTEM FOR AN OUTBOARD MOTOR

BACKGROUND OF THE INVENTION

This invention relates to a lubricating system for an outboard motor and more particularly to an improved arrangement for lubricating the driving gears of an oil pump for such an engine.

A known method for lubricating two-cycle engines is to employ a mixture of fuel and lubricant that is inducted into the crankcase. Such arrangements, however, do not necessarily insure that all components of the engine receive adequate amounts of lubrication under all running conditions. Therefore, it has been proposed to provide a pressure lubricating system for at least some components of two-cycle engines. Where the two-cycle engine is employed as an outboard motor, the engine and transmission are considerably removed from each other. Therefore, the oil pump must be driven directly by the engine crankshaft and normally worm or spiral gears are used for this purpose. As is well known, such gears require a fairly large degree of lubrication due to the heavy pressure under which they operate. With previously proposed lubricating systems, the drive gears of the oil pump have not always been adequately lubricated.

It is, therefore, a principal object of this invention to provide an improved lubricating system for an internal combustion engine.

It is a further object of the invention to provide a lubricating system for two-cycle engines.

It is yet another object of this invention to provide an improved arrangement for lubricating the drive gears of an oil pump of an engine.

SUMMARY OF THE INVENTION

This invention is adapted to be embodied in a lubricating system for a crankcase compression, two-cycle engine having a crankshaft rotatably supported in a crankcase. An oil pump drive means is affixed to the crankshaft and seal means are disposed on opposite sides of the oil pump drive means. Means deliver pressurized oil from the oil pump driven by the oil pump drive means to the oil pump drive means between the seal means.

DETAILED DESCRIPTION OF THE PREFERRED EMBODIMENTS

Figure 1:
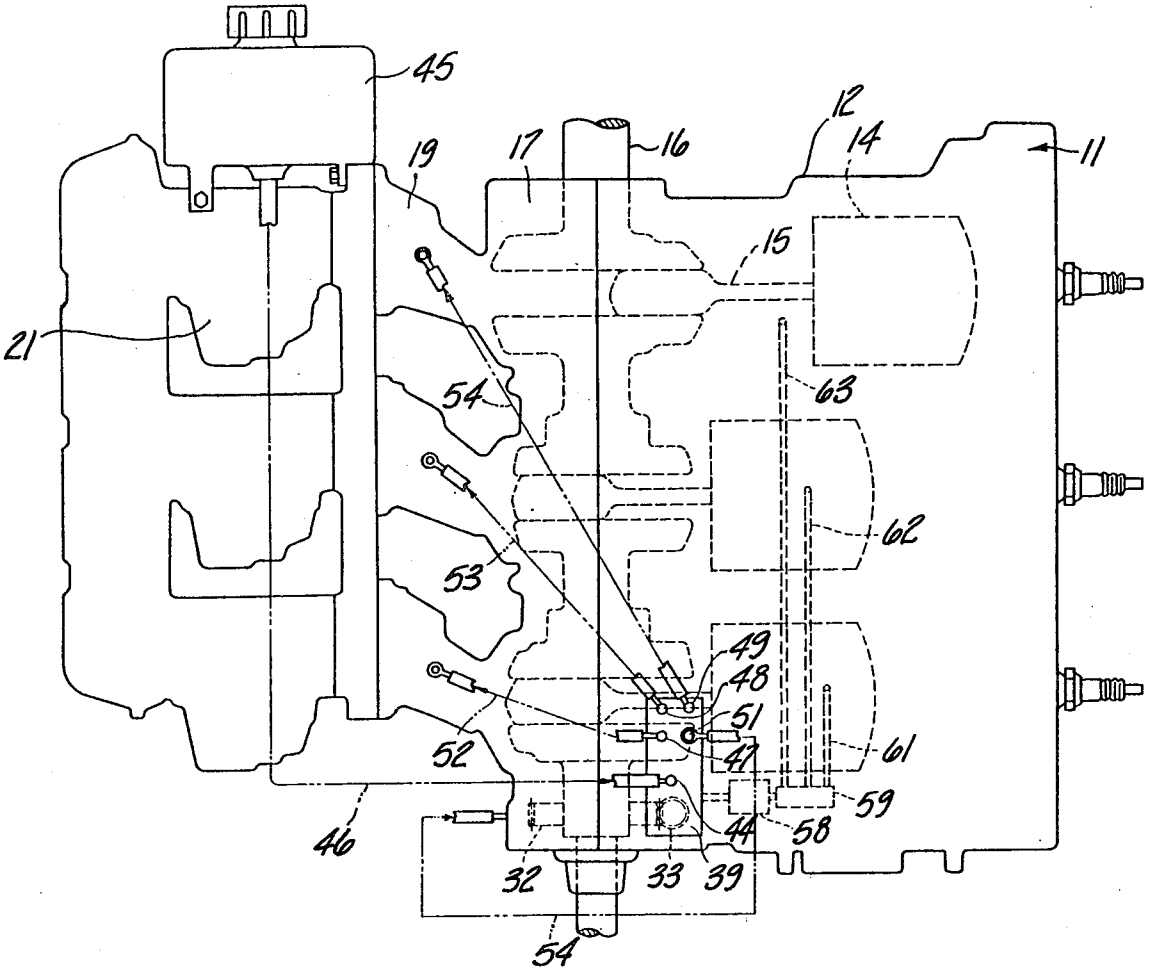
FIG. 1 is a side elevational view of an internal combustion engine constructed in accordance with an embodiment of the invention.

Referring first to FIG. 1, a two-cycle engine constructed in accordance with this invention is identified generally by the reference numeral 11. The engine 11 is of the three cylinder type operating on a two stroke principal having crankcase compression. The engine 11 is particularly adapted to be used in conjunction with outboard motors and for this reason is positioned with its crankshaft extending along a vertical axis, as will become apparent as the description proceeds.

The engine 11 includes a cylinder block 12 having cylinder bores 13 in which pistons 14 are supported for reciprocation. The pistons 14 are each connected, by means of connecting rods 15, to a crankshaft 16 that is supported for rotation about a vertically extending axis by means of main bearings formed in the cylinder block 12 and in a crankcase 17 that is affixed in a known manner to the cylinder block 12.

The cylinder block 12 and crankcase 17 form between them a chamber in which the crankshaft 16 rotates. The area between adjacent throws of the crankshaft 16 are sealed in an appropriate manner and provide individual chambers, one of which appears in FIG. 2 of the drawings and has been identified by the reference numeral 18. An intake manifold 19 supplies a fuel/air mixture to the crankcase chamber 18 from a suitable charge forming arrangement such as a series of carburetors 21.

One or more scavenging passages 19 extend through the cylinder block 12 from each crank chamber 18 to cylinder bore 13 for transferring the fuel/air mixture from the crankcase chamber 18 to the combustion chamber upon downward movement of the piston 14 as is well known with this type of engine.

Figure 2:
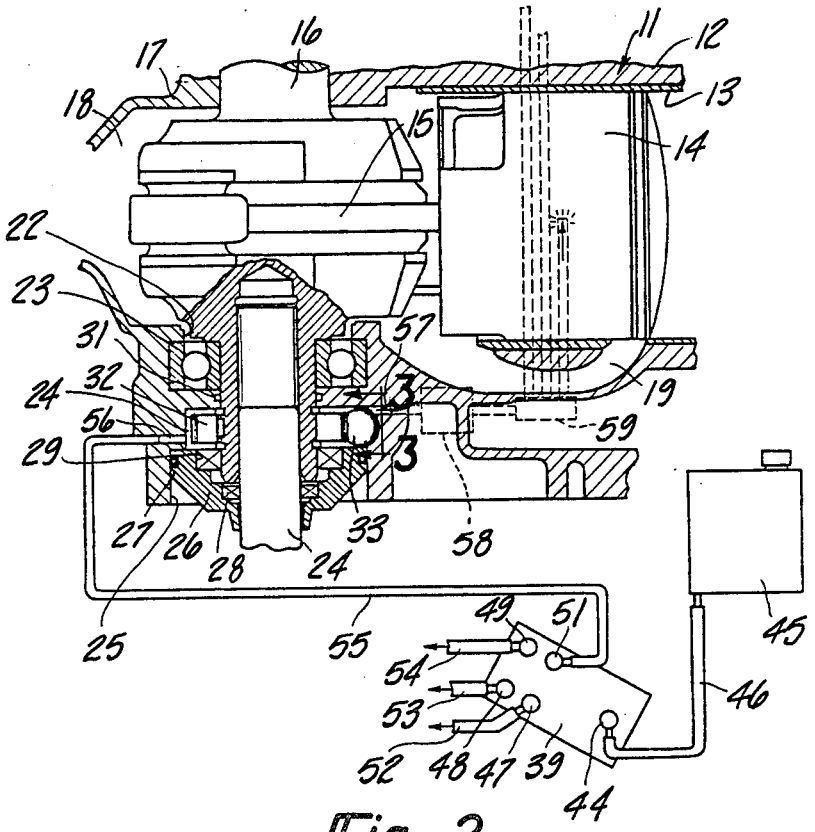
FIG. 2 is an enlarged cross-sectional view showing the oil pump drive mechanism for the engine and some of the lubricating components associated with it.
Figure 3:
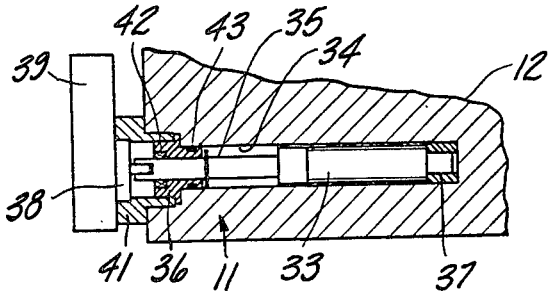
FIG. 3 is a cross-sectional view taken generally along the line 3—3 of FIG. 2.

Referring now primarily to FIGS. 2 and 3, the lower end of the cylinder block 12 and corresponding portion of the crankcase 17 are formed with a counterbore 22 in which a roller bearing 23 is supported for journalling the lower end of the crankshaft 16. A driveshaft 24 is rotatably coupled to this end of the crankshaft 16 for transmitting a final drive to the lower unit of the outboard motor (not shown) in a know manner.

A stepped counterbore is formed in the outer end of the cylinder block 12 and crankcase 17 around the lower end of the crankshaft 16. This stepped bore includes an oil pump drive cavity portion 30 and a larger diameter portion 25 which is, in turn, closed by a closure plug 26. An O-ring seal 27 is positioned in a groove in the closure plug 26 and sealingly engages the counterbore portion 25. In addition, a shaft seal 28 is formed at the lower end of the closure plug 26 for sealingly engaging the drive shaft 24. A still further seal 29 is disposed at the upper end of the closure plug 26 and sealingly engages this end of the crankshaft 16 so that the lower end of the oil pump gear cavity 30 is sealed. The upper end of this casing is also sealed by means of an O-ring 31 which is received in a circumferential groove in the cylinder block 12 and crankcase 17 and which sealingly engages the crankshaft 16.

An oil pump drive gear 32 is affixed for rotation with the crankshaft 16 within the oil pump drive cavity 30. The gear 32 in the illustrated embodiment comprises a worm gear. The worm gear 32 meshes with a worm wheel 33 that extends in a bore 34 (FIG. 3) that extends transversely to the cavity 30. The worm wheel 33 is supported upon a shaft 35 which is, in turn, journalled at its opposite ends by means of a pair of spaced bearings 36 and 37.

The end of the worm wheel shaft 35 is splined to drive an oil pump input shaft 38 of an oil pump assembly 39. The oil pump assembly 39 is supported on the cylinder block 11 by means of a supporting bracket 41.

The bearing 36 carries an inner seal 42 that sealingly engages the shaft 35 and an outer seal 43 that sealingly engages the bore 34 so as to prevent any oil leakage from around the gear 32 and 33. In this way, the cavity 30 is effectively sealed and provides an area that can be filled with oil, in a manner to be described.

FIGS. 1 and 2 show the oil pump 39 in a somewhat schematic fashion. The oil pump 39 has an inlet fitting 44 that receives oil from an oil sump 45 via a conduit 46. The oil pump 39 has one or more outlet fittings, there being four such fittings, identified by the reference numerals 47, 48, 49 and 51, in the illustrated embodiment. The outlet fitting 47 supplies oil under pressure to a conduit 52 which extends to lubricate the engine by means of a discharge nozzle that is positioned in one of the branch portions of the intake manifold 19 so that lubricating oil can be introduced to the charge delivered from the carburetor 21 for lubricating the lowermost cylinder. In a like manner, conduits 53 and 54 extend from the fittings 48 and 49 to the other two branches of the manifold 19 for lubricating the remaining two cylinders.

A conduit 55 extends from the fitting 51 and terminates in an oil inlet 56 formed in the crankcase 17 in proximity to the oil pump gear cavity 30. Hence, oil under pressure is delivered to this cavity for lubricating the gears 32 and 33.

If desired, a discharge passage 57 may extend from the opposite side of the oil pump gear cavity 30 for delivering oil to a filter 58 which in turn delivers the oil to a distributing manifold 59 for lubricating the cylinder walls of each cylinder via respective passages 61, 62 and 63. The passages 61, 62 and 63 terminate in the cylinder liners 13 at a point below the bottom dead center position of the pistons 14 so that these discharges will not be exposed into the combustion chambers.

It should be mentioned that check valves (not shown) may be provided at the outlets of the conduits 52, 53 and 54 so as to prevent any reverse flow through these conduits back to the oil pump.

As the engine is operated, the oil pump 39 will be driven so as to insure adequate lubrication of both the oil pump drive gears and also such other components of the engine as are desired. At all times, the oil pump drive chamber 30 will be filled with oil because of the pressurization of this chamber. Thus, the life of the engine can be significantly increased, particularly in view of the fact that a number of the components of the engine are lubricated. In addition to those components which have been described, oil may also be delivered to the various journals of the crankshaft 16 directly through suitable oil supply lines. Also, in lieu of lubricating of the cylinder liners directly, the oil may be returned from the oil cavity 30 to the oil tank 45 through the filter 58. Although various embodiments of the invention have been described, other changes and modifications may be made without departing from the spirit and scope of the invention as defined by the appended claims.

I claim:

1. A lubricating system for a crankcase compression, two-cycle engine having a crankshaft rotatably supported in a crankcase, an oil pump drive means affixed to said crankshaft, a cavity enclosing said oil pump drive means, seal means disposed on opposite sides of said oil pump drive means and sealing said cavity, and means for delivering pressurized oil from the oil pump driven by said oil pump drive means to said cavity for lubricating said oil pump drive means between said seal means.

2. A lubricating system as set forth in claim 1 wherein the oil pump drive means comprises a gear affixed to the crankshaft, said gear being affixed to said crankshaft adjacent to an opening in an end wall of the engine, said opening being closed by a closure plug which carries sealing means for sealing the corresponding end of the crankshaft and gear cavity.

3. A lubricating system as set forth in claim 1 wherein the oil from the area between the sealing means is delivered from the oil pump drive means to other components of the engine to be lubricated.

4. A lubricating system as set forth in claim 1 wherein oil is returned from the area between the seal means through a filter.

5. A lubricating system as set forth in claim 1 wherein the crankshaft extends through an end wall of the engine, said end wall being formed with a stepped counterbore therein, the oil pump drive means comprising a drive gear affixed to the crankshaft in the innermost of said counterbores, the outermost of said counterbores being closed by a closure plug carrying sealing means for engaging the crankshaft and wall for sealing the adjacent end of the innermost counterbore.

* * * * *